US010480191B2

(12) United States Patent
Edwards

(10) Patent No.: US 10,480,191 B2
(45) Date of Patent: Nov. 19, 2019

(54) METHOD AND APPARATUS FOR SETTING CONCRETE REINFORCEMENT

(71) Applicant: James Thomas Edwards, Locust, NC (US)

(72) Inventor: James Thomas Edwards, Locust, NC (US)

( * ) Notice: Subject to any disclaimer, the term of this patent is extended or adjusted under 35 U.S.C. 154(b) by 0 days.

(21) Appl. No.: 15/651,008

(22) Filed: Jul. 17, 2017

(65) Prior Publication Data

US 2018/0023299 A1 Jan. 25, 2018

Related U.S. Application Data

(60) Provisional application No. 62/363,906, filed on Jul. 19, 2016.

(51) Int. Cl.

| | |
|---|---|
| ***E04C 5/18*** | (2006.01) |
| ***E04C 5/16*** | (2006.01) |
| ***E04C 5/03*** | (2006.01) |
| ***E04C 3/00*** | (2006.01) |
| ***E04G 21/18*** | (2006.01) |
| ***E04C 5/04*** | (2006.01) |
| ***E04C 5/20*** | (2006.01) |
| *E04B 1/348* | (2006.01) |
| *E04B 2/02* | (2006.01) |
| *E04H 4/00* | (2006.01) |

(52) U.S. Cl.

CPC ..... *E04C 5/18* (2013.01); *E04C 3/00* (2013.01); *E04C 5/03* (2013.01); *E04C 5/04* (2013.01); *E04C 5/163* (2013.01); *E04C 5/168* (2013.01); *E04C 5/206* (2013.01); *E04G 21/185* (2013.01); *E04B 1/34823* (2013.01); *E04B 2002/0254* (2013.01); *E04H 4/0081* (2013.01)

(58) Field of Classification Search

CPC ..... E04C 5/18; E04C 3/00; E04C 5/03; E04C 5/163; E04B 1/34823; E04B 2002/0254

USPC ..... 52/678, 684, 687; 187/27, 130

See application file for complete search history.

(56) References Cited

U.S. PATENT DOCUMENTS

| | | | | | |
|---|---|---|---|---|---|
| 1,880,710 | A | * | 10/1932 | Bitney | E04C 5/18 404/135 |
| 2,308,142 | A | * | 1/1943 | Alloway | E04G 3/22 182/150 |
| 3,510,097 | A | * | 5/1970 | McCaleb | E04G 3/20 182/150 |
| 3,515,244 | A | * | 6/1970 | Weible | E04G 3/20 182/150 |
| 4,059,248 | A | * | 11/1977 | Kuntz | A47H 27/00 108/149 |

(Continued)

*Primary Examiner* — Patrick J Maestri

(74) *Attorney, Agent, or Firm* — Trego, Hines & Ladenheim, PLLC

(57) ABSTRACT

A fixture for setting rebar at a predetermined distance from the rim of an excavated pit includes elongated first and second legs each having a proximal end and a distal end, the first and second legs rigidly joined at their mutual proximal ends to form an L-shape; an angle adjustment device carried by the first leg, comprising a foot movable towards or away from the first leg along an axis generally parallel to the second leg; a support bracket carried by the first leg at a predetermined offset distance from the proximal end thereof; and a hook extending from the distal end of the second leg, generally parallel to the first leg.

11 Claims, 5 Drawing Sheets

(56) References Cited

U.S. PATENT DOCUMENTS

2014/0115996 A1* 5/2014 Hurst ..... E04G 21/185
52/701

* cited by examiner

METHOD AND APPARATUS FOR SETTING CONCRETE REINFORCEMENT

BACKGROUND OF THE INVENTION

This invention relates generally to concrete construction, and more particularly to methods and apparatus for setting reinforcement elements such as rebar for reinforced concrete.

Reinforced concrete is a well-known construction material which comprises concrete having a reinforcing material such as steel bars or rods embedded therein. This type of reinforcement is referred to generally as "rebar". Reinforced concrete has beneficial structural properties of both concrete and the reinforcing material.

Reinforced concrete is often used to form the floor and walls of in-ground swimming pools and similar structures. Typically, the rebar is positioned in place in an excavated pit, and then covered with a sprayable concrete material, for example shotcrete or gunite.

One problem with this type of construction is that the sections of the rebar must be set on a level plane, but a convenient level reference is not usually available.

BRIEF SUMMARY OF THE INVENTION

This problem is addressed by a fixture and a method for setting rebar prior to applying concrete.

According to one aspect of the technology described herein, a fixture for setting rebar at a predetermined distance from the rim of an excavated pit includes: elongated first and second legs each having a proximal end and a distal end, the first and second legs rigidly joined at their mutual proximal ends to form an L-shape; an angle adjustment device carried by the first leg, comprising a foot movable towards or away from the first leg along an axis generally parallel to the second leg; a support bracket carried by the first leg at a predetermined offset distance from the proximal end thereof; and a hook extending from the distal end of the second leg, generally parallel to the first leg.

According to another aspect of the technology described herein, a method for setting rebar at a predetermined distance from the rim of an excavated pit includes: placing a plurality of fixtures at spaced-apart locations around the rim of a pit excavated into the earth, the pit defined by a recessed floor bounded by a generally vertical perimeter wall and being surrounded by a rim, and wherein an upstanding form is disposed around the perimeter of the rim laterally offset from the perimeter wall, each fixture including: elongated first and second legs each having a proximal end and a distal end, the first and second legs rigidly joined at their mutual proximal ends to form an L-shape; an angle adjustment device carried by the first leg, comprising a foot movable towards or away from the first leg along an axis generally parallel to the second leg; a support bracket joined to the first leg at a predetermined offset distance from the proximal end thereof; and a hook extending from the distal end of the second leg, generally parallel to the first leg; positioning the hook of each of the fixtures in engagement with the form; adjusting each of the fixtures using the angle adjustment device so that the first leg is plumb; and placing a length of rebar into the pit, engaged with the support brackets of the plurality of fixtures, such that the rebar is positioned at a substantially uniform vertical offset distance from the rim.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
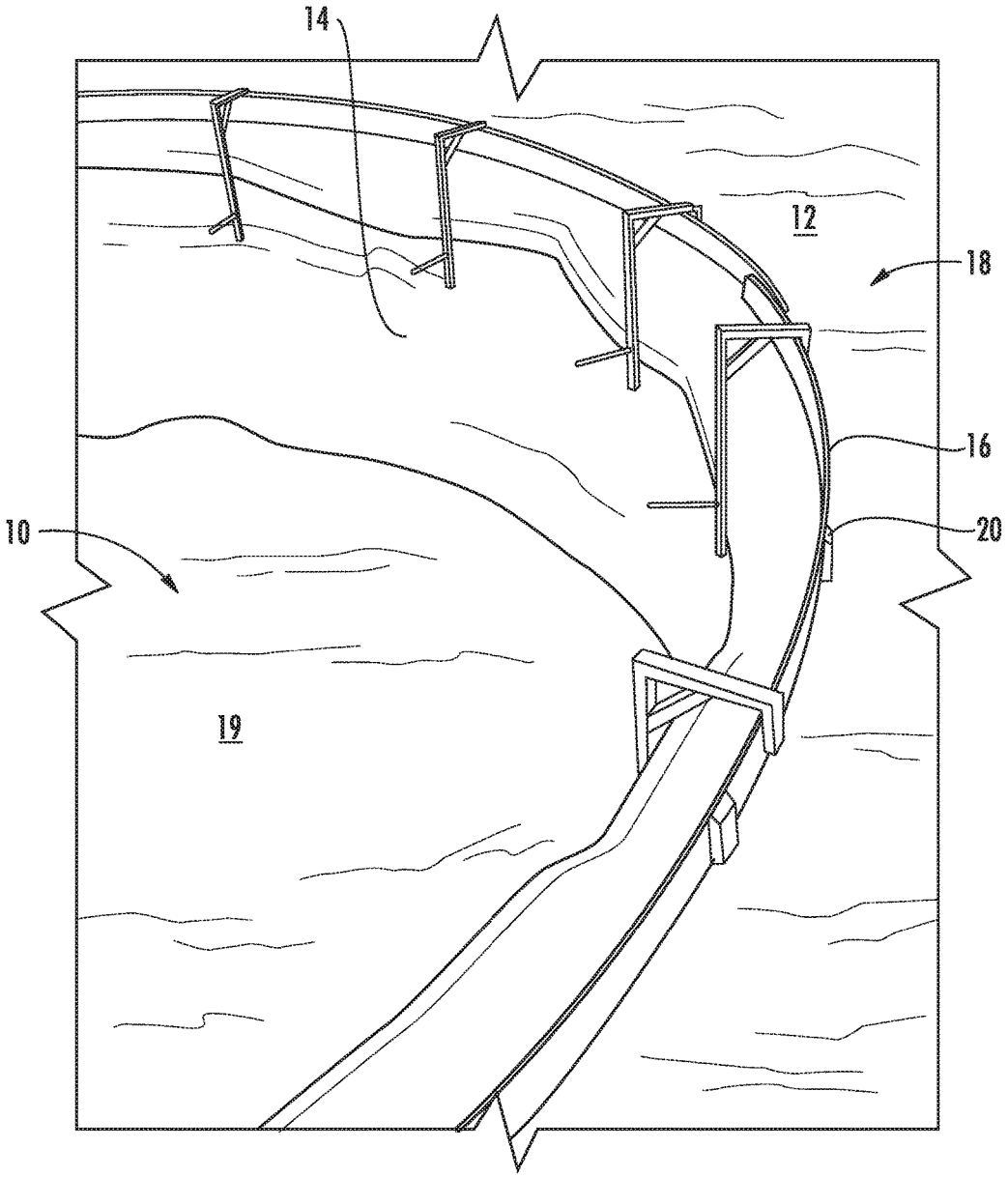
FIG. 1 is a perspective view of a swimming pool under construction.

Referring to the drawings wherein identical reference numerals denote the same elements throughout the various views, FIG. 1 illustrates an exemplary pit 10 excavated into the earth 12 in order to construct a swimming pool or similar structure. The pit 10 has a perimeter wall 14 extending downward from the ground surface 18, and a floor 19.

A form 16 is placed on the ground surface 18 surrounding all or a portion of the pit 10. In the illustrated example, the form 16 comprises a thin flexible sheet material such as FORMICA secured in place with stakes 20. The form 16 is typically offset laterally from the perimeter wall 14 by a specified dimension, for example about 30 cm (12 inches).

Figure 2:
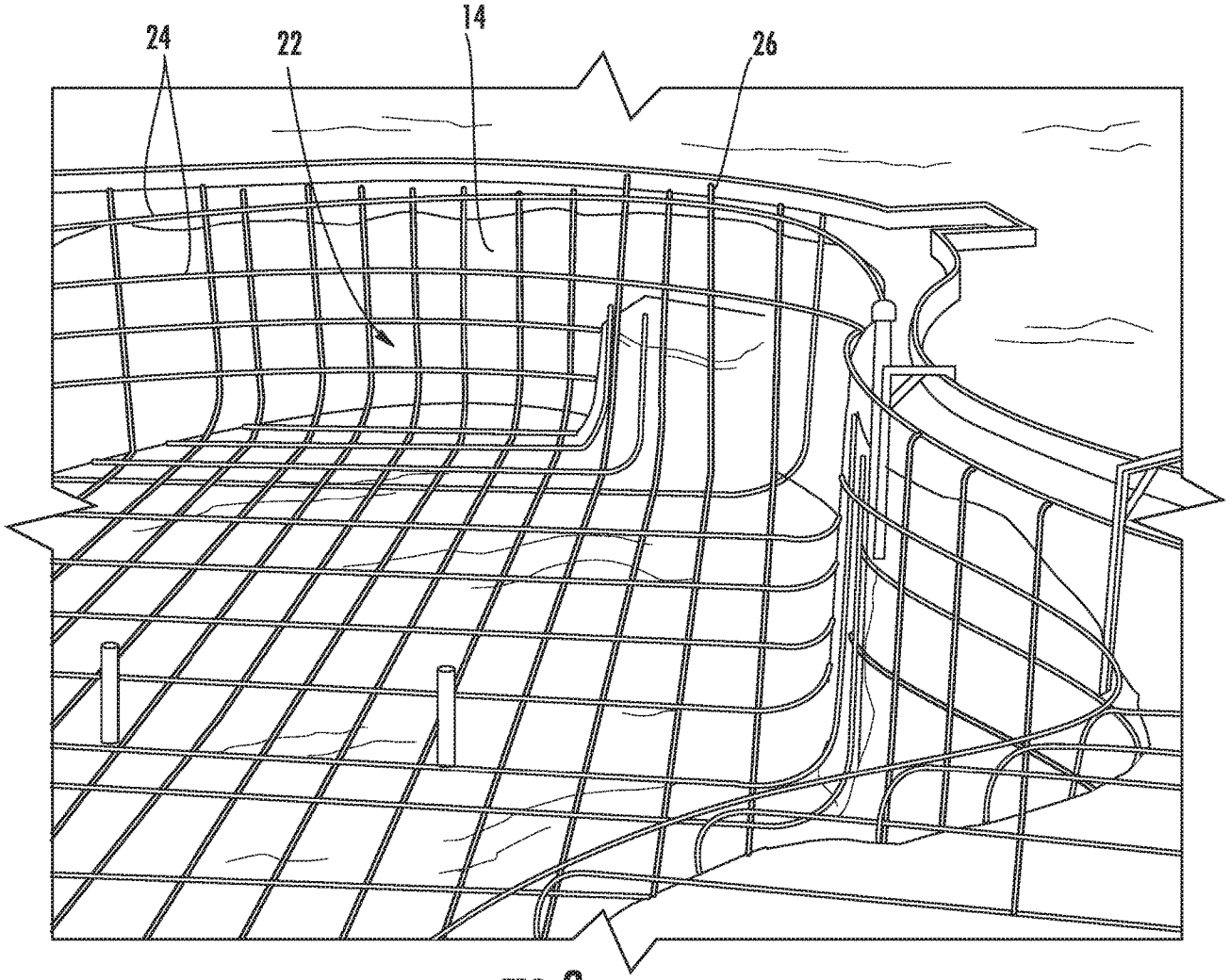
FIG. 2 is another perspective view of the swimming pool of FIG. 1.

As seen in FIG. 2, prior to applying concrete, a reinforcing structure 22 is placed into the pit 10 adjacent the perimeter wall 14. Typically, the reinforcing structure 22 comprises a plurality of lengths of rebar. The rebar is configured in a grid pattern of horizontal rails 24 and uprights 26 which are tied to each other at their intersections using wire ties or other similar conventional structure.

It will be understood that it is desirable for the rails 24 to be placed in a true level orientation relative to the Earth, i.e. each complete rail lies in a single horizontal plane. It will be further understood that the floor 19 of the pit 10 will likely not be completely level, either intentionally or unintentionally. Accordingly, it is generally necessary to use the form 16 as a level reference for the uppermost rail 24 (the top of the form 16 would typically be set level to the Earth during installation). More specifically, multiple measurements are taken along the length of the rail 24 to ensure that the rail 24 is a constant vertical distance from the form everywhere around its perimeter.

Unfortunately, making these measurements is complicated by the fact that the form is offset from the perimeter wall 14. This means that a single measuring instrument cannot easily be used to obtain an accurate measurement.

Additionally, even if all measurements are correct, the rail 24 must be held in the proper position until the complete reinforcing structure 22 is complete. In the prior art, this generally entails the use of pins or rods driven into the perimeter wall 14 of the pit 10. For various reasons, these cannot be left in place and thus require additional labor to remove before the concrete can be applied.

Figure 3:
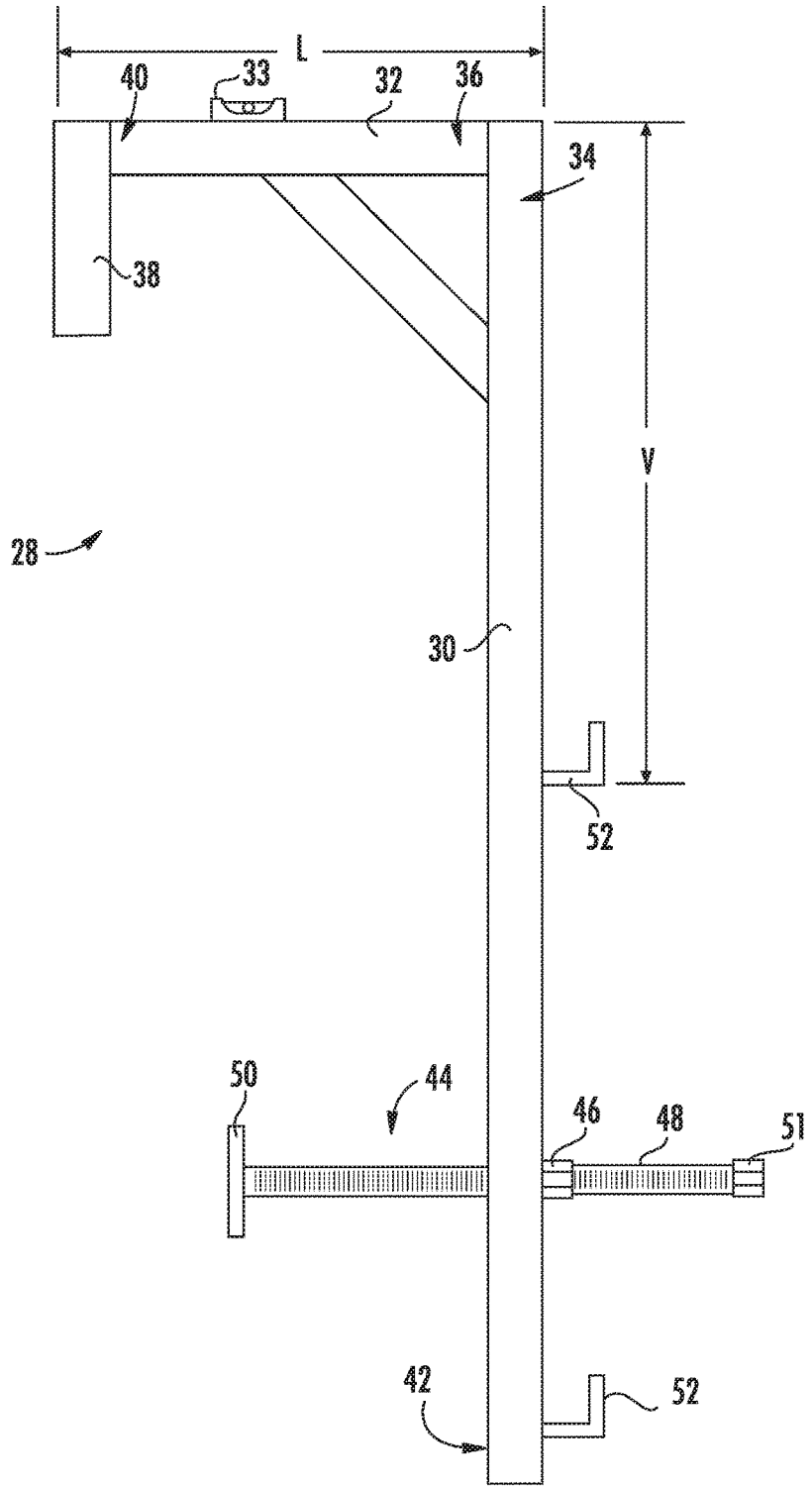
FIG. 3 is a schematic side view of a fixture for setting reinforcing bar.

FIG. 3 illustrates a tool or fixture 28 which may be used to set the rebar while avoiding the above-noted problems. The fixture is generally L-shaped and includes a first or vertical leg 30 and a second or horizontal leg 32 which meet at mutual proximal ends 34, 36. A hook 38 extends downward from the distal end 40 of the second leg 32.

An angle adjustment device 44 is disposed at or near the distal end 42 of the first leg 30. In the illustrated example, the angle adjustment device 44 comprises a first threaded element 46 (such as a nut) affixed to or integral with the first leg 30, and a second threaded element 48 (such as a threaded rod or bolt) which engages the first threaded element 46. The second threaded element 48 includes a foot 50 (such as a flat plate) at one end, and a head 51 at the opposite end configured to be engaged by a wrench or other similar tool. For example, the head 51 may have a hexagonal shape.

Rotation of the second threaded element 48 in one direction moves the foot 50 towards the first leg 30, and rotation of the second threaded element 48 and the opposite direction moves the foot 50 away from the first leg 30.

For the purposes of the present invention, any mechanism which provides a foot that can move inward and outward relative to the first leg 30 (or in other words along an axis generally parallel to the second leg 32) may be used in place of the two threaded elements described above.

A support bracket 52 is affixed to or integral with the first leg 30 and is located a predetermined vertical offset distance "V" from the second leg 32. In the illustrated example, the support bracket 52 comprises a short section of L-shaped stock defining an upward-facing hook. If desired, multiple support brackets 52 may be provided at preselected distances along the first leg 30, as shown.

Optionally, the support bracket 52 or brackets may be made movable or adjustable. For example, the first leg 30 could be provided with a plurality of spaced-apart holes, and the support bracket 52 could be attached using a fastener passing through a selected one of the holes. Alternatively, the vertical leg could be attached to the first leg 30 using a sliding connection.

Optionally, the fixture 28 may be provided with means for measuring its inclination, such as a known type of mechanical or electronic level. For example, in FIG. 3 a conventional bubble level 33 is shown attached to the second leg 32.

The fixture 28 and its constituent components may be constructed from any suitable material that will maintain its rigidity and dimensional stability in use. Nonlimiting examples of suitable materials include wood, plastics, composite materials, and metals. In the illustrated example, the fixture 28 is fabricated from sections of steel tubing and steel angle stock welded together.

Figure 4:
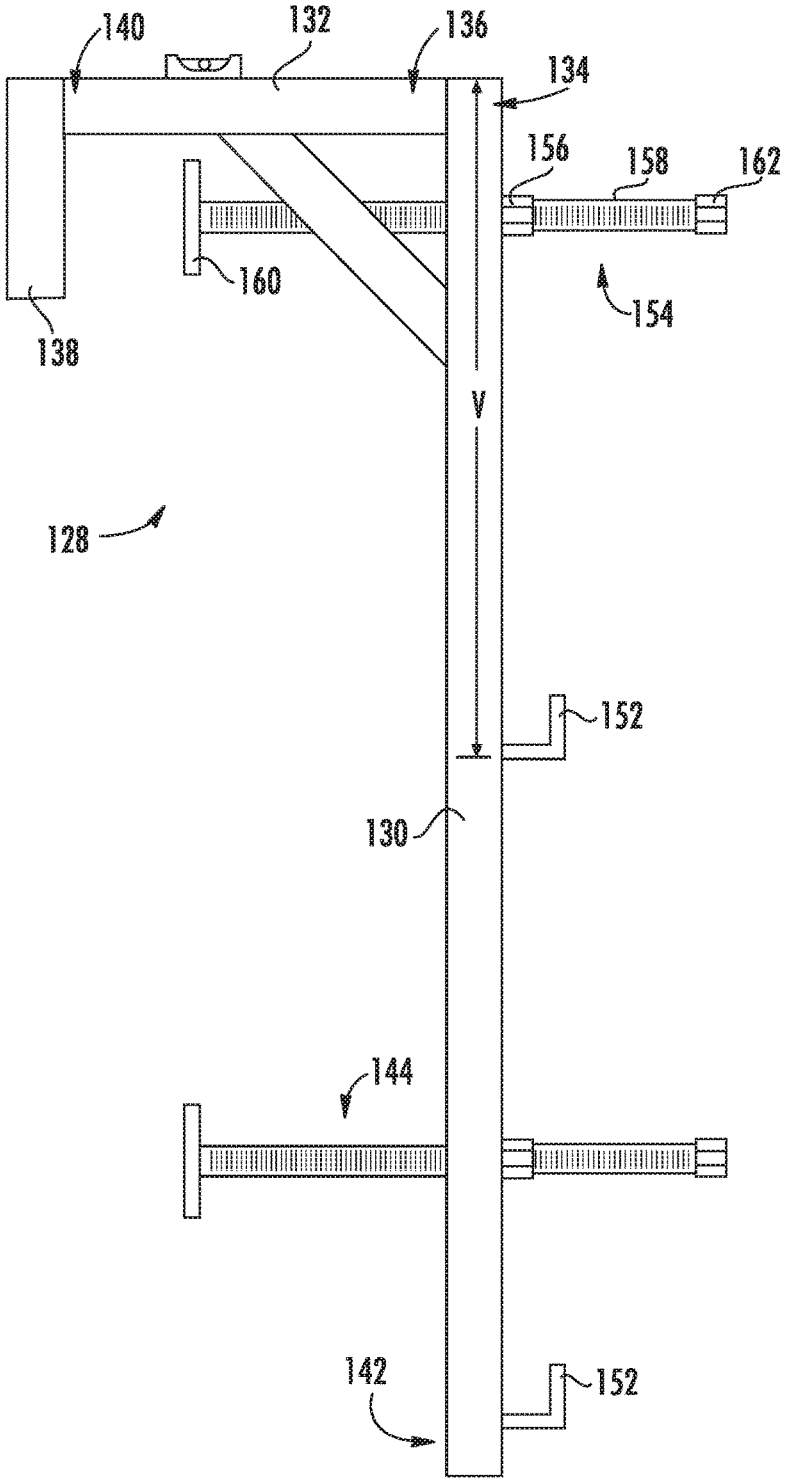
FIG. 4 is a schematic side view of an alternative setting fixture.

FIG. 4 illustrates an alternative fixture 128 which is generally similar in construction to the fixture 28 described above. Elements of the fixture 128 not explicitly described may be considered to be identical to those of the fixture 28 described above.

The fixture 128 includes a vertical leg 130 and a horizontal leg 132 which meet at mutual proximal ends 134, 136. A hook 138 extends downward from a distal end 140 of the horizontal leg 132. An angle adjustment device 144 is disposed at or near a distal end 142 of the vertical leg 130. At least one support bracket 152 is affixed to or integral with the vertical leg 130 and is located a predetermined vertical offset distance "V" from the horizontal leg 132.

The fixture 128 further includes a clamping mechanism 154. In illustrated example, the clamping mechanism 154 comprises a first threaded element 156 affixed to or integral with the vertical leg 130, near the proximal end 134 of the vertical leg 130, and a second threaded element 158 which engages the first threaded element 156. The second threaded element 158 includes a jaw 160 at one end (for example a flat plate), and a head 162 at the opposite end configured to be engaged by a wrench or other similar tool. For example, the head 162 may have a hexagonal shape. Rotation of the second threaded element in one direction moves the jaw 160 towards the hook 138, and rotation of the second threaded element 158 in the opposite direction moves the jaw 160 away from the hook 138.

Figure 5:
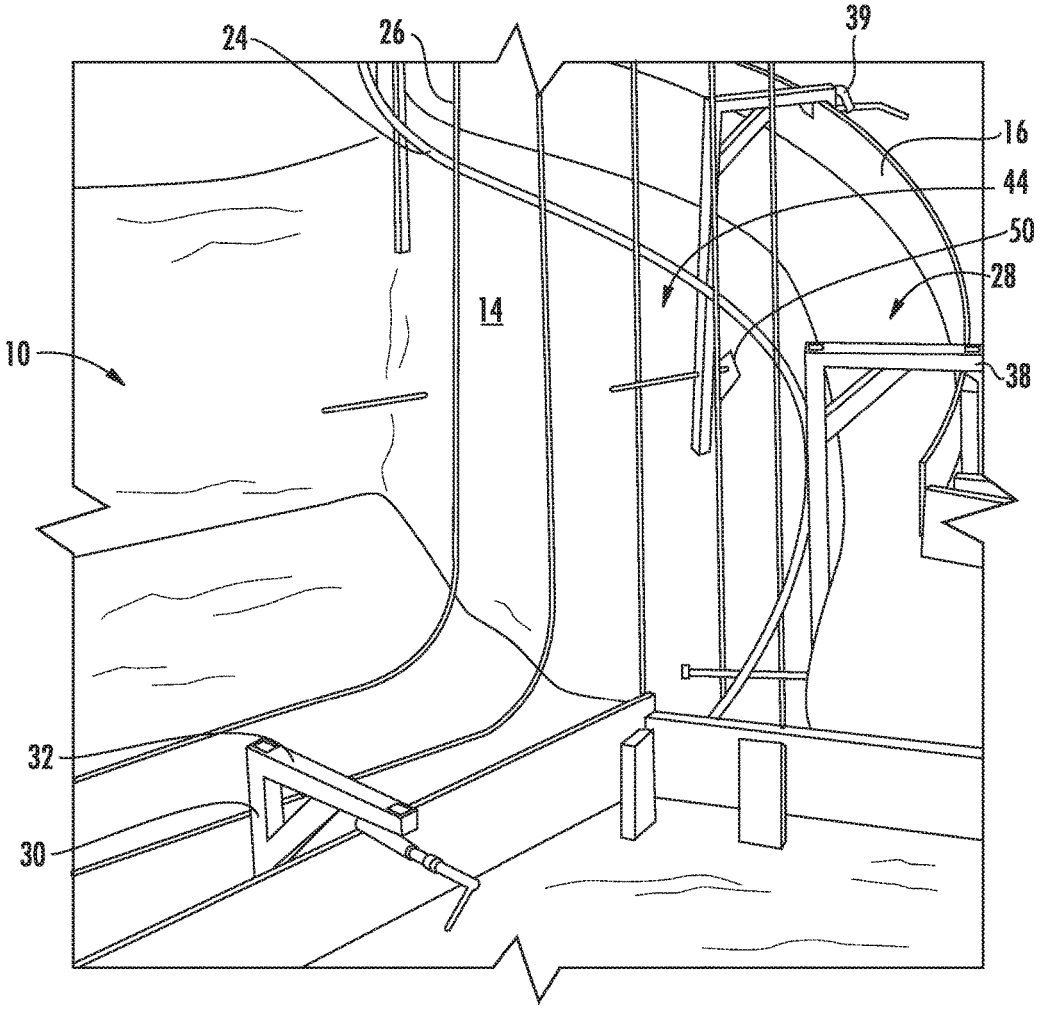
FIG. 5 is a perspective view showing the fixture in use.

The use of the fixture 28 will now be described with reference to FIG. 5. Initially, a pit 10 is formed as described above, and the form 16 is installed. Next, the fixture 28 is set into place adjacent the perimeter wall 14 with the hook 38 abutting the form 16. This sets the first leg 30 at a fixed, predetermined lateral distance "L" (FIG. 3) away from the form 16. The hook 38 is then secured to the form 16 to prevent the fixture 28 from moving. In the example shown in FIG. 5, the hook 38 is secured by using a conventional C-clamp 39. Alternatively, using the fixture 128, the built-in clamping mechanism 154 would be used to secure the hook 138 to the form 16. As another alternative, any conventional clamping or fastening means may be used. For example, a mechanical fastener such as a screw or bolt could be driven through the hook 38 and the form 16.

Once the fixture 28 is secured, it is adjusted to ensure that the first leg 30 is in fact vertical or "plumb" to the Earth. This may be done by using a conventional bubble level (not shown) placed abutting the second leg 32 or the first leg 30, or by using the built-in inclination measuring means, if present. The foot 50 bears against the perimeter wall 14. Therefore, using the angle adjusting device 44 to move the foot 50 towards or away from the first leg 30 will cause the fixture 28 to pivot.

Once the fixture 28 is set with the first leg 30 plumb to the earth, the support bracket 52 will be positioned at a specific lateral distance L from the form 16, and a specific vertical distance V as described above. The same procedure is repeated using a plurality of identical fixtures 28 around the entire perimeter of the pit 10.

Once all the fixtures 28 are set, a length of rebar may then be set into each of the support brackets 52, thus forming a rail 24 which is substantially in a single plane at a fixed distance below the ground surface 18. This result is obtained without the need for any measuring. The process may be continued by placing additional rails below the first rail 24. Because the first rail 24 lies in a single plane, it is possible to set the next rail 24 by using simple offset measurements from the first rail 24. Alternatively, if the fixture 28 incorporates multiple support brackets 52 as described above, then the additional rails 24 may be formed by placing additional lengths of rebar into the additional support brackets 52. The uprights 26 described above may then be set in place and connected to the rails 24.

Once the support structure is in place, it is a self-supporting and the fixtures 28 are no longer required. Accordingly, the fixtures 28 may be removed prior to the application of concrete. Fixtures 28 may be reused indefinitely.

The apparatus and method described herein has numerous benefits compared to the prior art. A primary benefit is a large reduction in the time required to set the reinforcing structure. Another benefit is the ease of removal of the fixtures after use.

The foregoing has described apparatus and methods for supporting a reinforcing structure. All of the features disclosed in this specification, and/or all of the steps of any method or process so disclosed, may be combined in any combination, except combinations where at least some of such features and/or steps are mutually exclusive.

Each feature disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends, or to any novel one, or any novel combination, of the steps of any method or process so disclosed.

What is claimed is:

1. A fixture for setting rebar at a predetermined distance from the rim of an excavated pit, comprising:

elongated first and second legs each having a proximal end and a distal end, the first and second legs rigidly joined at their mutual proximal ends to form an L-shape;

an angle adjustment device carried by the first leg, comprising a foot movable towards or away from the first leg along an axis generally parallel to the second leg, wherein a first threaded element is fixedly joined to the first leg, and a second threaded element is engaged with the first threaded element, and wherein the second threaded element carries the foot and is arranged such that rotation of the second threaded element relative to the first threaded element will cause linear movement of the foot;

a support bracket carried by the first leg at a predetermined offset distance from the proximal end thereof, the support bracket has an L-shape defining an upward-facing hook shape; and a fixed hook extending from the distal end of the second leg, generally parallel to the first leg; wherein the fixture is removed after the rebar is set in place.

2. The fixture of claim 1 further comprising a level attached to one of the legs.

3. The fixture of claim 1 wherein a plurality of spaced-apart support brackets are carried by the first leg.

4. The fixture of claim 1 further comprising an integral clamping mechanism carried by the first leg, comprising a jaw positioned opposite to the hook and movable towards or away from the hook.

5. The fixture of claim 4 wherein the integral clamping mechanism comprises a first threaded element fixedly joined to the first leg, and a second threaded element engaged with the first threaded element, the second threaded element carrying the jaw and arranged such that rotation of the second threaded element relative to the first threaded element will cause linear movement of the jaw.

6. A method for setting rebar at a predetermined distance from the rim of an excavated pit, comprising:

placing a plurality of fixtures at spaced-apart locations around the rim of a pit excavated into the earth, the pit defined by a recessed floor bounded by a generally vertical perimeter wall and being surrounded by a rim, and wherein an upstanding form is disposed around the perimeter of the rim laterally offset from the perimeter wall, each fixture including:

elongated first and second legs each having a proximal end and a distal end, the first and second legs rigidly joined at their mutual proximal ends to form an L-shape;

an angle adjustment device carried by the first leg, comprising a foot movable towards or away from the first leg along an axis generally parallel to the second leg, wherein the angle adjustment device comprises a first threaded element fixedly joined to the first leg, and a second threaded element engaged with the first threaded element, the second threaded element carrying the foot;

a support bracket joined to the first leg at a predetermined offset distance from the proximal end thereof, wherein each of the support brackets has an L-shape defining an upward-facing hook; and a fixed hook extending from the distal end of the second leg, generally parallel to the first leg;

positioning the hook of each of the fixtures in engagement with the form;

adjusting each of the fixtures using the angle adjustment device so that the first leg is plumb by rotating the second threaded element so as to move the foot into a position in which it bears against the perimeter wall and hold the respective fixture in the plumb orientation; and placing a length of rebar into the pit, engaged with the support brackets of the plurality of fixtures, such that the rebar is positioned at a substantially uniform vertical offset distance from the rim.

7. The method of claim 6 further comprising clamping each of the fixtures to the form.

8. The method of claim 7 wherein a separate clamp is used to clamp at least some of the fixtures to the form.

9. The method of claim 7 wherein at least some of the fixtures include an integral clamping mechanism carried by the first leg, comprising a jaw positioned opposite to the hook and movable towards or away from the hook, the method further comprising using the integral clamping mechanisms to clamp the corresponding fixtures to the form.

10. The method of claim 6 wherein at least some of the fixtures include an integral level attached to one of the legs, and those fixtures are adjusted to the plumb orientation by referencing the integral levels.

11. The method of claim 6 wherein the first leg of each fixture includes a plurality of spaced-apart support brackets carried by the first leg at multiple predetermined positions, the method further comprising placing a plurality of lengths of rebar into the pit, each length engaged with the support brackets of the plurality of fixtures, at one of the predetermined positions, thus defining a plurality of rails supported at different vertical offset distances from the rim.

* * * * *